US010202978B2

(12) United States Patent
Choi et al.

(10) Patent No.: US 10,202,978 B2
(45) **Date of Patent: *Feb. 12, 2019**

(54) SCROLL COMPRESSOR

(71) Applicant: LG ELECTRONICS INC., Seoul (KR)

(72) Inventors: Yongkyu Choi, Seoul (KR); Kangwook Lee, Seoul (KR); Cheolhwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 2 days.

This patent is subject to a terminal disclaimer.

(21) Appl. No.: 15/817,584

(22) Filed: Nov. 20, 2017

(65) Prior Publication Data

US 2018/0073506 A1 Mar. 15, 2018

Related U.S. Application Data

(63) Continuation-in-part of application No. 14/710,704, filed on May 13, 2015, now Pat. No. 10,041,493.

(30) Foreign Application Priority Data

Aug. 13, 2014 (KR) ..... 10-2014-0105227

(51) Int. Cl.
*F04C 18/00* (2006.01)
*F04C 18/02* (2006.01)
(Continued)

(52) U.S. Cl.
CPC ..... *F04C 18/0261* (2013.01); *F04C 18/0215* (2013.01); *F04C 18/0292* (2013.01);
(Continued)

(58) Field of Classification Search
CPC ..... F04C 18/0215; F04C 18/0261; F04C 23/008; F04C 29/12
See application file for complete search history.

(56) References Cited

U.S. PATENT DOCUMENTS 4,714,415 A 12/1987 Mizuno et al.
4,818,195 A 4/1989 Murayama et al.
(Continued)

FOREIGN PATENT DOCUMENTS

CN 1367320 9/2002
CN 101675248 3/2010
(Continued)

OTHER PUBLICATIONS

Chinese Office Action dated Feb. 4, 2017 (with English Translation).
(Continued)

*Primary Examiner* — Audrey K Bradley
*Assistant Examiner* — Anthony Ayala Delgado
(74) *Attorney, Agent, or Firm* — Ked & Associates LLP

(57) ABSTRACT

A scroll compressor is provided that may include a first compression chamber, a second compression chamber separated from the first compression chamber and having a greater compression ratio than the first compression chamber, a first discharge port that communicates with the first compression chamber and provided with a first discharge inlet and a first discharge outlet, and a second discharge port separated from the first discharge port, that communicates with the second compression chamber, and provided with a second discharge inlet and a second discharge outlet, the second discharge inlet having a larger sectional area than the first discharge inlet. The first discharge inlet and the first discharge outlet may have a same cross section, and the second discharge inlet and the second discharge outlet may
(Continued)

have a same cross section. Accordingly, a discharge delay in each compression chamber may be prevented in advanced, and thus, compression loss may be suppressed.

17 Claims, 12 Drawing Sheets

(51) Int. Cl.
*F04C 29/12* (2006.01)
*F04C 23/00* (2006.01)

(52) U.S. Cl.
CPC ..... *F04C 29/12* (2013.01); *F04C 23/008* (2013.01); *F04C 2250/102* (2013.01)

(56) References Cited

U.S. PATENT DOCUMENTS

| | | | |
|---|---|---|---|
| 8,790,098 | B2 | 7/2014 | Stover et al. |
| 9,267,501 | B2 | 2/2016 | Akei |
| 2010/0303659 | A1 | 12/2010 | Stover et al. |

FOREIGN PATENT DOCUMENTS

| | | |
|---|---|---|
| CN | 102042224 | 5/2011 |
| CN | 102678550 | 9/2012 |
| JP | 5-280476 | 10/1993 |
| KR | 10-1059880 | 8/2011 |

OTHER PUBLICATIONS

U.S. Appl. No. 14/710,704, filed May 13, 2015, Anthony Ayala Delgado.

U.S. Appl. No. 15/817,531, filed Nov. 20, 2017, Anthony Ayala Delgado.

U.S. Appl. No. 15/817,584, filed Nov. 20, 2017, Anthony Ayala Delgado.

U.S. Appl. No. 15/817,657, filed Nov. 20, 2017, Anthony Ayala Delgado.

U.S. Office Action issued in U.S. Appl. No. 15/817,657 dated Apr. 6, 2018.

SCROLL COMPRESSOR

CROSS-REFERENCE TO RELATED APPLICATION(S)

This application is a Continuation-in-part of copending U.S. application Ser. No. 14/710,704 filed on May 13, 2015 which claims priority under 35 U.S.C. 119(a) to Application No. 10-2014-00105227, filed in the Republic of Korea on Aug. 13, 2014, all of which are hereby expressly incorporated by reference into the present invention.

BACKGROUND

1. Field

A scroll compressor, and more particularly, a scroll compressor having discharge ports through which compressed refrigerant is discharged is disclosed herein.

2. Background

The scroll compressor is a compressor forming a compression chamber made of a suction chamber, an intermediate pressure chamber, and a discharge chamber between a plurality of scrolls while the plurality of scrolls perform a relative orbiting motion in an engaged state. Such a scroll compressor may obtain a relatively high compression ratio as compared with other types of compressors while smoothly connecting suction, compression, and discharge strokes of refrigerant, thereby obtaining a stable torque. Therefore, the scroll compressor is widely used for compressing refrigerant in an air conditioner, for example. Recently, a high-efficiency scroll compressor having a lower eccentric load and an operation speed at about 180 Hz or higher has been introduced.

Behavior characteristics of the scroll compressor may be determined by a shape of a fixed wrap and an orbiting wrap. The fixed wrap and the orbiting wrap may have any shape, but usually have a form of an involute curve that can be easily processed. The involute curve denotes a curve corresponding to a trajectory drawn by an end of thread when the thread wound around a base circle having an arbitrary radius is released. When the involute curve is used, a thickness of the wrap is constant and a capacity change rate may also be constant, and therefore, a number of turns of the wrap should be increased to obtain a high compression ratio, but in this case, it has a drawback in which a size of the compressor also increases.

Further, the orbiting scroll is typically provided with an orbiting wrap formed on one surface of a disk-shaped plate, and a boss portion formed on a rear surface without the orbiting wrap and connected to a rotary shaft to orbitally drive the orbiting scroll. Such a shape may form the orbiting wrap over a substantially overall area of the disk plate, thereby decreasing a diameter of the disk plate for obtaining the same compression ratio. In contrast, an action point to which a repulsive force of refrigerant is applied and an action point to which a reaction force for cancelling out the repulsive force is applied are separated from each other in a vertical direction, thereby causing a problem of increasing vibration or noise while the behavior of the orbiting scroll becomes unstable during the operation process.

In view of this, there has been developed a so-called shaft-through scroll compressor in which a point at which the rotary shaft and the orbiting scroll are coupled to each other overlaps the orbiting wrap in a radial direction. In such a shaft-through scroll compressor, an action point of a repulsive force of refrigerant and an action point of the reaction force may act on a same point, thereby greatly reducing a problem of the inclination of the orbiting scroll.

In the related art shaft-through scroll compressor, as the rotary shaft is coupled through a center of a compression unit, a discharge port is located at a position which is eccentric from a center of the compression unit to avoid interference with the rotary shaft. Accordingly, the shaft-through scroll compressor is provided with a plurality of discharge ports that communicate with the plurality of compression chambers, respectively, to prevent over-compression due to a discharge delay, and thus, prevent a compression loss of the compressor.

However, in the related art shaft-through scroll compressor, although flow rates at which refrigerant flows are different in both compression chambers due to different (compression) gradients of the two compression chambers, both of the discharge ports are formed without considering a difference in flow rate of the refrigerant. As a result, there are problems that over-compression occurs in the discharge port due to a relatively increased discharge flow rate of refrigerant in a compression chamber having a relatively large gradient, and a compression loss increases due to the over-compression.

In addition, the related art shaft-through scroll compressor has a limitation in securing processability while reducing compression loss due to the over-compression. For example, when the discharge port has a circular cross section, an inner diameter of the discharge port must be increased to enlarge a sectional area of the discharge port as the discharge port has a same inner diameter. However, considering interference with other parts (for example, a plurality of bypass valves) provided adjacent to the discharge port, there is a limit in increasing the inner diameter of the discharge port. Accordingly, the sectional area of the discharge port is limited or even reduced. This causes an increase in flow resistance while refrigerant is discharged and brings about an increase in the over-compression loss.

BRIEF DESCRIPTION OF THE DRAWINGS

Embodiments will be described in detail with reference to the following drawings in which like reference numerals refer to like elements, and wherein.

DETAILED DESCRIPTION

Description will now be given of a scroll compressor according to an embodiments disclosed herein, with reference to the accompanying drawings. In general, a scroll compressor may be divided into a low pressure type in which a suction pipe communicates with an internal space of a casing forming a low pressure portion and a high pressure type in which a suction pipe directly communicates with the compression chamber. Accordingly, in the low pressure type, a drive unit is provided in a suction space which is the low pressure portion, whereas in the high pressure type, a drive unit is provided in a discharge space which is the high pressure portion. Such a scroll compressor may be divided into an upper compression type and a lower compression type according to positions of the drive unit and the compression unit. A compressor in which the compression unit is located above the drive unit is referred to as an "upper compression type", and a compressor in which the compression unit is located below the drive unit is referred to as a "lower compression type". Hereinafter, a scroll compressor of a type in which a rotary shaft overlaps an orbiting wrap on a same plane will be exemplarily described as a lower compression type scroll compressor. This type of scroll compressor is known to be suitable for application to a refrigeration cycle under high temperature and high compression ratio conditions.

Figure 1:
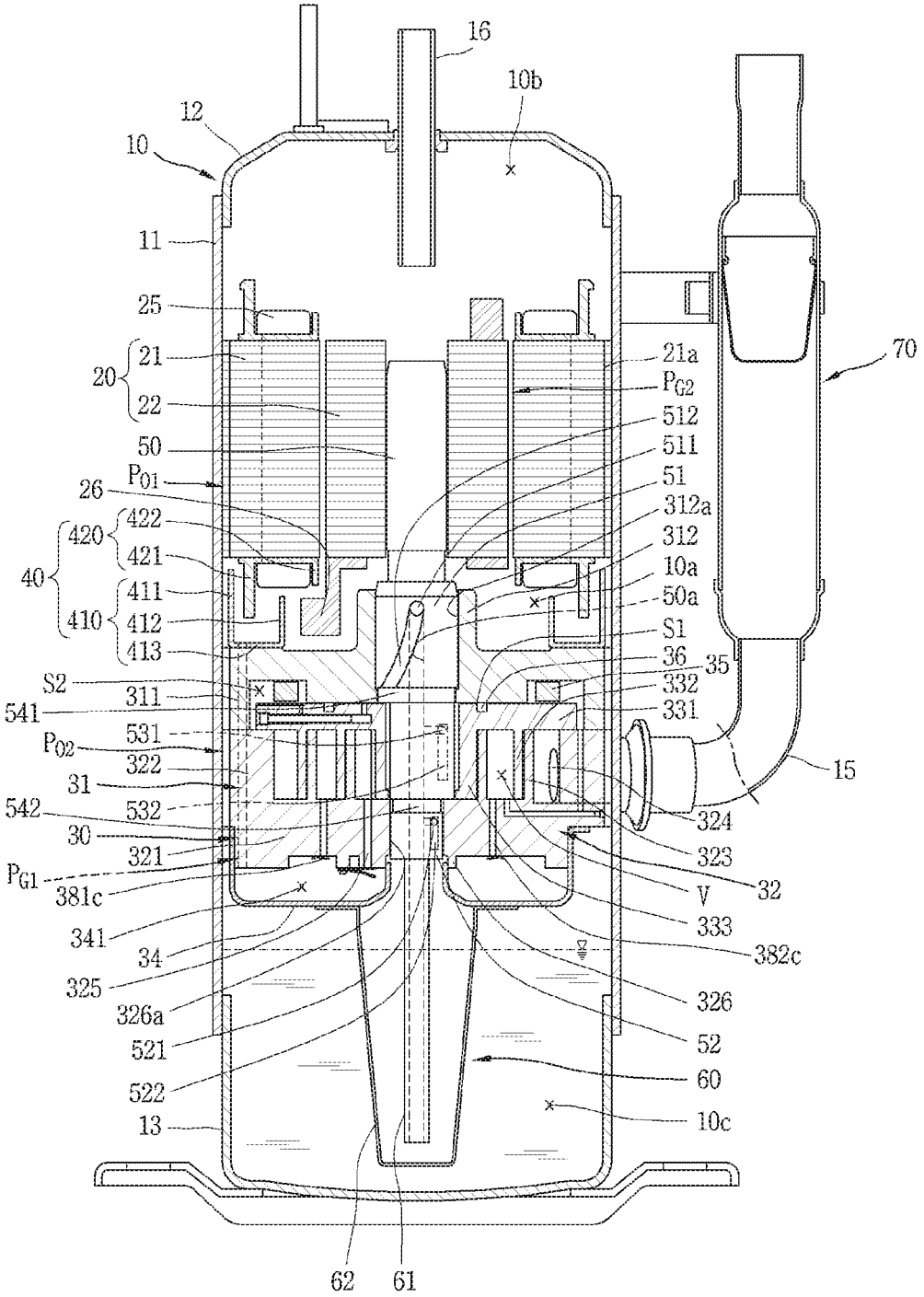
FIG. 1 is a cross-sectional view of a lower compression-type scroll compressor in accordance with an embodiment.
Figure 2:
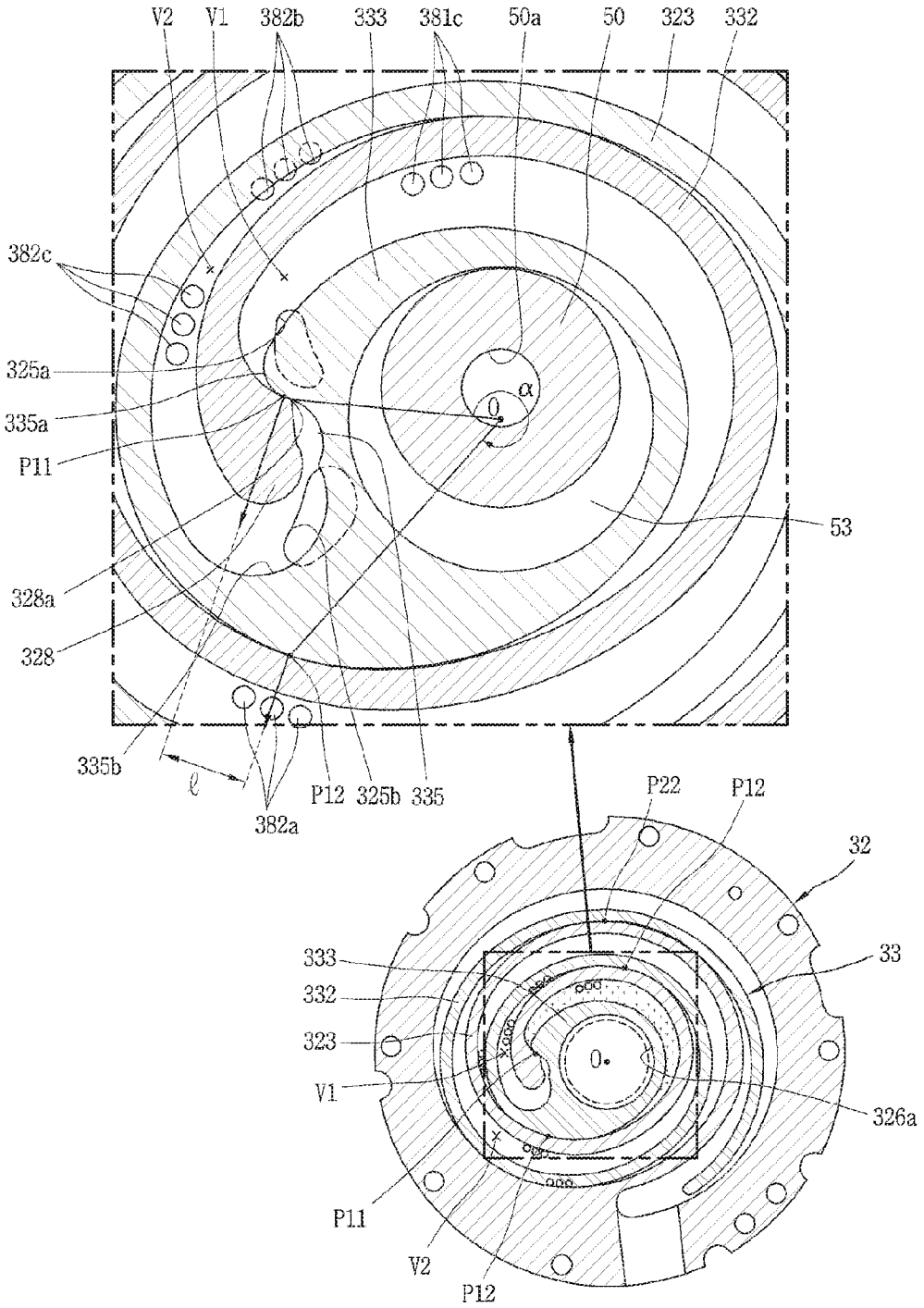
FIG. 2 is a cross-sectional view of a compression unit in FIG. 1.
Figure 3:
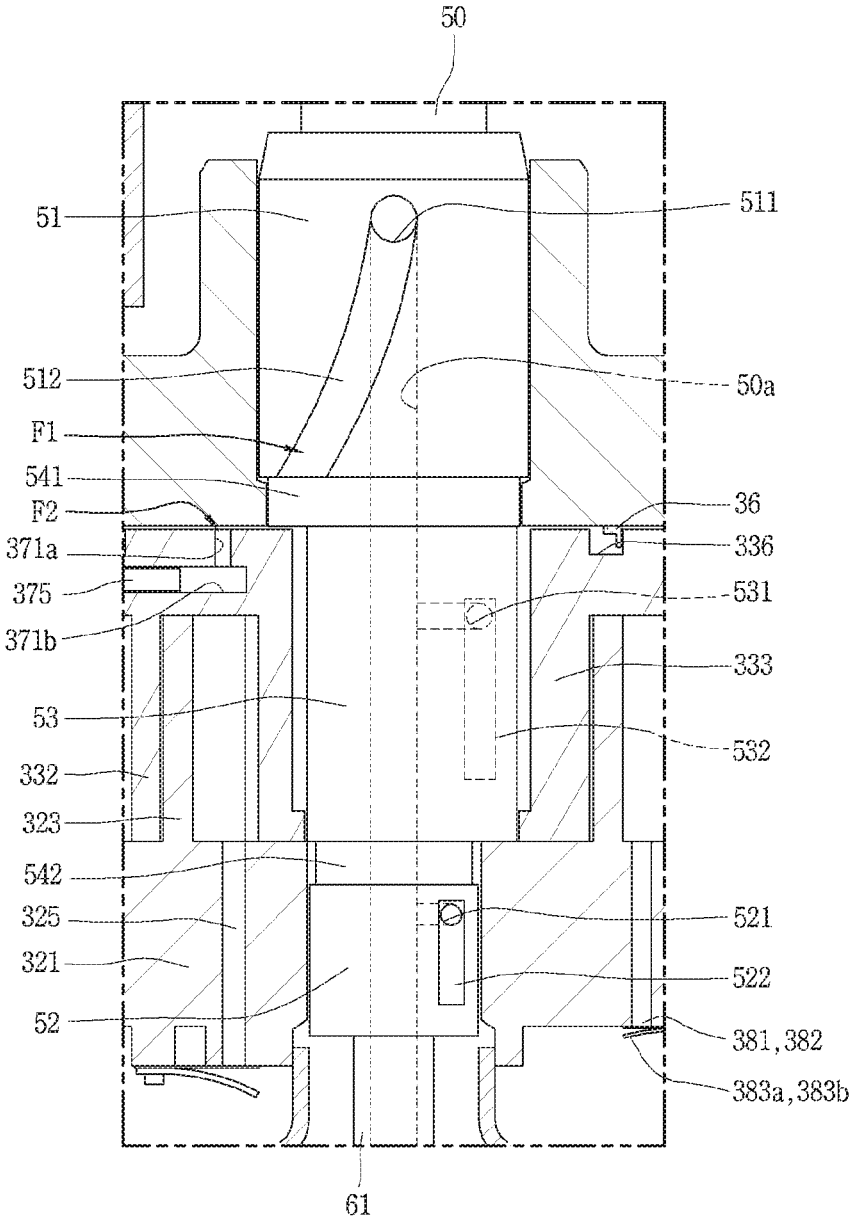
FIG. 3 is a front partial cross-sectional view illustrating a portion of a rotary shaft for explaining a sliding portion in FIG. 1.
Figure 4:
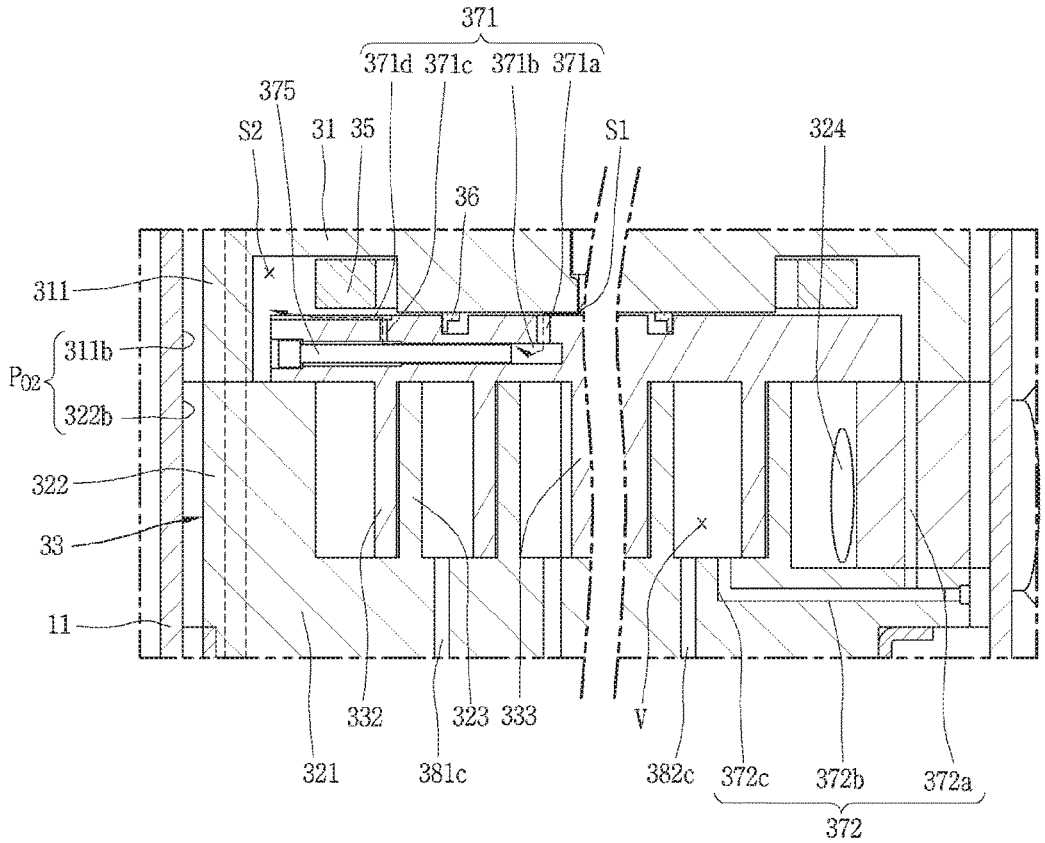
FIG. 4 is a cross-sectional view illustrating an oil supply passage (oil feeding path) between a back pressure chamber and a compression chamber in FIG. 1.

FIG. 1 is a cross-sectional view of a lower compression-type scroll compressor in accordance with an embodiment. FIG. 2 is a cross-sectional view of a compression unit of FIG. 1. FIG. 3 is a front partial, cross-sectional view illustrating a portion of a rotatory shaft for illustrating a sliding portion in FIG. 1. FIG. 4 is a cross-sectional view illustrating an oil supply passage (oil feeding path) between a back pressure chamber and a compression chamber in FIG. 1.

Referring to FIG. 1, a lower compression type scroll compressor according to an embodiment may be provided with a motor unit or motor 20 having a drive motor within a casing 10 to generate a rotational force, and a compression unit 30 located below the motor unit 20 and having a predetermined space (hereinafter, referred to as an "intermediate space") 10*a* to compress refrigerant by receiving the rotational force of the motor unit 20.

The casing 10 may include a cylindrical shell 11 forming a hermetic container, an upper shell 12 forming the hermetic container by covering an upper portion of the cylindrical shell 11, and a lower shell 13 forming the hermetic container by covering a lower portion of the cylindrical shell 11 and simultaneously forming an oil storage space 10*c*.

A refrigerant suction pipe 15 may directly communicate with a suction chamber of the compression unit 30 through a lateral surface of the cylindrical shell 11, and a refrigerant discharge pipe 16 that communicates with an upper space 10*b* of the casing 10 may be provided through a top of the upper shell 12. The refrigerant discharge pipe 16 may correspond to a path through which compressed refrigerant discharged from the compression unit 30 to the upper space 10*b* of the casing 10 is discharged to outside. The refrigerant discharge pipe 16 may be inserted up to a middle of the upper space 10*b* of the casing 10 to allow the upper space 10*b* to form a kind of oil separation space. Further, according to circumstances, an oil separator (not shown) that separates oil mixed with refrigerant may be connected to the refrigerant suction pipe 15 within the casing 10 including the upper space 10*b* or within the upper space 10*b*.

The motor unit 20 may include a stator 21 and a rotor 22 that rotates within the stator 21. The stator 21 may be provided with teeth and slots forming a plurality of coil winding portions (not shown) on an inner circumferential surface thereof along a circumferential direction, such that a coil 25 may be wound therearound. A second refrigerant passage $P_{G2}$ may be formed by combining a gap between the inner circumferential surface of the stator 21 and an outer circumferential surface of the rotor 22 with the coil winding portions. As a result, refrigerant discharged into the intermediate space 10*a* between the motor unit 20 and the compression unit 30 through a first refrigerant passage $P_{G1}$, which will be described hereinafter, may flow to the upper space 10*b* formed above the motor unit 20 through the second refrigerant passage $P_{G2}$ formed in the motor unit 20. As a result, refrigerant discharged into the intermediate space 10*a* between the motor unit 20 and the compression unit 30 through a first refrigerant passage $P_{G1}$, which will be described hereinafter, flows to the upper space 10*b* formed above the motor unit 20 through the second refrigerant passage $P_{G2}$ formed in the motor unit 20.

Further, a plurality of D-cut faces 21*a* may be formed on an outer circumferential surface of the stator 21 along a circumferential direction. The plurality of D-cut face 21*a* may form a first oil passage $P_{O1}$ together with an inner circumferential surface of the cylindrical shell 11 to allow a flow of oil. As a result, oil separated from refrigerant in the upper space 10*b* flows to the lower space 10*c* through the first oil passage $P_{O1}$ and a second oil passage $P_{O2}$, which will be described hereinafter.

A frame 31 forming the compression unit 30 may be fixedly coupled to an inner circumferential surface of the casing 10 with a predetermined interval below the stator 21. An outer circumferential surface of the frame 31 may be shrink-fitted to or fixedly welded, for example, on an inner circumferential surface of the cylindrical shell 11.

A frame sidewall portion or sidewall (first sidewall portion or sidewall) 311 in an annular shape may be formed at an edge of the frame 31, and a plurality of communication grooves 311*b* may be formed on an outer circumferential surface of the first sidewall portion 311 along the circumferential direction. The communication grooves 311*b* form the second oil passage $P_{O2}$ together with a communication groove 322*b* of a first scroll 32, which will be described hereinafter.

In addition, a first bearing 312 that supports a main bearing 51 of a rotary shaft 50, which will be described hereinafter, may be formed in a center of the frame 31, and a first bearing hole 312*a* may be formed through the first bearing 312 in an axial direction such that the main bearing 51 of the rotary shaft 50 may be rotatably inserted and supported in a radial direction.

The fixed scroll (hereinafter, referred to as a "first scroll") 32 may be provided on a lower surface of the frame 31 with interposed therebetween an orbiting scroll (hereinafter, referred to as a "second scroll") 33, which may be eccentrically connected to the rotary shaft 50. The first scroll 32 may be fixedly coupled to the frame 31, but may also be movably coupled to the frame 31 in the axial direction.

On the other hand, the first scroll 32 may be provided with a fixed disk portion or disk (hereinafter, referred to as a "first disk portion" or "first disk") 321 formed in a substantially disk shape, and a scroll sidewall portion or "second sidewall" (hereinafter, referred to as a "second sidewall portion" or "second sidewall") 322 formed at an edge of the first disk portion 321 and coupled to a lower edge of the frame 31.

A suction port 324 through which the refrigerant suction pipe 15 and a suction chamber communicate with each other may be formed through one side (or portion) of the second sidewall portion 322, and a discharge port 325 which communicates with a discharge chamber and through which compressed refrigerant is discharged may be formed through a central portion of the first disk portion 321. The discharge port 325 may be provided with a first discharge port 325*a* and a second discharge port 325*b* to independently communicate with a first compression chamber V1 and a second compression chamber V2 disclosed hereinafter. These discharge ports will be described hereinafter.

In addition, the communication groove 322*b* is formed on an outer circumferential surface of the second sidewall portion 322, and forms the second oil passage $P_{O2}$ that guides collected oil to the lower space 10*c*, together with the communication grooves 311*b* of the first sidewall portion 311.

A discharge cover 34 that guides refrigerant discharged from compression chamber V to a refrigerant passage, which will be described hereinafter, may be coupled to a lower side of the first scroll 32. An inner space 341 of the discharge cover 34 may receive the first discharge port 325*a* and the second discharge port 325*b* and simultaneously receive an inlet of the first refrigerant passage $P_{G1}$ to guide refrigerants discharged from the compression chamber V through the discharge ports 325*a* and 325*b* to the upper space 10*b* of the casing 10, more particularly, a space between the motor unit 20 and the compression unit 30.

The first refrigerant passage $P_{G1}$ may be formed sequentially through the second sidewall portion 322 of the fixed scroll 32 and the first sidewall portion 311 of the frame 31 from an inside of a passage separation unit or separator 40, namely, from a side of the rotary shaft 50, which is located at an inside based on the passage separation unit 40. As a result, the second oil passage $P_{O2}$ may be formed at an outside of the passage separation unit 40 to communicate with the first oil passage $P_{O1}$.

A fixed wrap (hereinafter, referred to as a "first wrap") 323 forming the compression chamber V in engagement with an orbiting wrap (hereinafter, referred to as a "second wrap") 332, which will be described hereinafter, may be formed on an upper surface of the first disk portion 321. The first wrap 331 will be described hereinafter together with the second wrap 332.

A second bearing 326 that supports a sub-bearing 52 of the rotary shaft 50, which will be described hereinafter, may be formed in a center of the first disk portion 321, and a second bearing hole 326*a* may be formed through the second bearing 326 in the axial direction to support the sub-bearing 52 in a radial direction.

The first disk portion 321 may be provided with bypass holes 381 and 382 that bypass a portion of refrigerant to be compressed in advance and bypass valves 383 (383*a*, 383*b*) installed or provided at outlet ends of the bypass holes 381 and 382, respectively. Each of the bypass holes 381 and 382 may be provided as one or as a plurality at at least one appropriate position along a moving (advancing) direction of the compression chamber V so as to be located between a suction chamber and a discharge chamber.

For example, as illustrated in FIG. 2, first bypass holes may be formed in the first compression chamber V1 and second bypass holes may be formed in the second compression chamber V2. The bypass holes in each compression chamber may be spaced apart from each other by a predetermined interval along the moving direction of the compression chamber V.

The first bypass holes 381 and the second bypass holes 382 may be arranged in a spaced manner by a predetermined rotational angle in the respective compression chambers V1 and V2. However, the interval between the bypass holes may differ depending on a condition of each compression chamber.

More specifically, as the second compression chamber V2 has a larger compression gradient than the first compression chamber V1, the intervals between the second bypass holes 382 belonging to the second compression chamber V2 may be decreased toward a discharge side. For example, when the first bypass holes arranged in a direction from a suction end to a discharge end of the first wrap are referred to as 381*a*, 381*b*, and 381*c* and the second bypass holes arranged in a same way are referred to as 382*a*, 382*b*, and 382*c*, respectively, the interval between the second bypass holes 382*c* and 382*b* may be significantly narrower than the interval between the first bypass holes 381*c* and 381*b* closest to the discharge end.

Each bypass hole 381 and 382 may be provided as one in number along each of the compression chambers V1 and V2, or as illustrated in FIG. 2, may be provided in plurality (three in the drawing) as a group. For the sake of explanation, the plurality of bypass holes may be referred to as a "bypass portion".

In this manner, according to this embodiment, a compression chamber having a relatively large compression gradient (or volume reduction gradient) has a large bypass area. Accordingly, even if one compression chamber has a relatively large compression gradient, a large amount of refrigerant may be bypassed just before the refrigerant is discharged from the compression chamber, thereby preventing compression loss due to over-compression.

On the other hand, the second scroll 33 may be provided with an orbiting disk portion or disk (hereinafter, referred to as "second disk portion" or "second disk") 331 formed in a substantially disk shape. A second wrap 332 forming a compression chamber in engagement with the first wrap 323 may be formed on a lower surface of the second disk portion 331.

The second wrap 332 may be formed in an involute shape together with the first wrap 323, but may also be formed in various other shapes. For example, as illustrated in FIG. 2, the second wrap 332 may have a shape in which a plurality of arcs having different diameters and origins are connected, and an outermost curve may be formed in a substantially elliptical shape having a major axis and a minor axis. The first wrap 323 may be formed in a similar manner.

A rotary shaft coupling portion or coupler 333 which forms an inner end portion of the second wrap 332 and to which an eccentric portion 53 of the rotary shaft 50 described hereinafter may be rotatably inserted may be formed through a central portion of the second disk portion 331 in the axial direction. An outer circumferential portion of the rotary shaft coupling portion 333 may be connected to the second wrap 332 to form the compression chamber V together with the first wrap 322 during a compression process.

The rotary shaft coupling portion 333 may be formed at a height overlapping with the second wrap 332 on a same plane, and thus, the eccentric portion 53 of the rotary shaft 50 may be formed at a height overlapping with the second wrap 332 on the same plane. Accordingly, a repulsive force and a compressive force of refrigerant offset each other while being applied to the same plane based on the second disk portion 331, thereby preventing an inclination of the second scroll 33 due to an action of the compressive force and repulsive force.

In addition, the rotary shaft coupling portion 333 is provided with a concave portion 335 formed on an outer circumferential portion facing an inner end portion of the first wrap 323 and engaged with a protruding portion 328 of the first wrap 323, which will be described hereinafter. An increasing portion 335*a* is formed at one side of the concave portion 335 having a thickness increasing from an inner circumferential portion to an outer circumferential portion of the rotary shaft coupling portion 333 at an upstream side along a forming direction of the compression chamber V. Accordingly, a compression path of the first compression chamber V1 immediately before discharge may extend and thus a compression ratio of the first compression chamber V1 may be increased to be similar to a compression ratio of the second compression chamber V2. The first compression chamber V1 is a compression chamber formed between an inner surface of the first wrap 323 and an outer surface of the second wrap 332, and will be described hereinafter separately from the second compression chamber V2.

At another side of the concave portion 335 is formed an arcuate compression surface 335*b* having an arcuate shape. A diameter of the arcuate compression surface 335*b* is decided by a thickness of the inner end portion of the first wrap 323, that is, a thickness of the discharge end, and an orbiting radius of the second wrap 332. When the thickness of the inner end portion of the first wrap 323 increases, a diameter of the arcuate compression surface 335*b* increases. As a result, a thickness of the second wrap 332 around the arcuate compression surface 335*b* may increase to ensure durability, and the compression path may extend to increase the compression ratio of the second compression chamber V2 to that extent.

In addition, the protruding portion 328 protruding toward the outer circumferential portion of the rotary shaft coupling portion 333 may be formed adjacent to an inner end portion (a suction end or starting end) of the first wrap 323 corresponding to the rotary shaft coupling portion 333. The protruding portion 328 may be provided with a contact portion 328*a* protruding therefrom and engaged with the concave portion 335. In other words, the inner end portion of the first wrap 323 may be formed to have a larger thickness than other portions. As a result, a wrap strength at the inner end portion of the first wrap 323, which is subjected to the highest compressive force on the first wrap 323, may increase so as to enhance durability.

On the other hand, the compression chamber V may be formed between the first disk portion 321 and the first wrap 323, and between the second wrap 332 and the second disk portion 331, and have a suction chamber, an intermediate pressure chamber, and a discharge chamber which are formed sequentially along a proceeding direction of the wrap. As illustrated in FIG. 2, the compression chamber V may include the first compression chamber V1 formed between an inner surface of the first wrap 323 and an outer surface of the second wrap 332, and the second compression chamber V2 formed between an outer surface of the first wrap 323 and an inner surface of the second wrap 332.

In other words, the first compression chamber V1 may include a compression chamber formed between two contact points P11 and P12 generated in response to the inner surface of the first wrap 323 being brought into contact with the outer surface of the second wrap 332, and the second compression chamber V2 may include a compression chamber formed between two contact points P21 and P22 generated in response to the outer surface of the first wrap 323 being brought into contact with the inner surface of the second wrap 332.

When a large angle of angles formed between two lines that connect a center of the eccentric portion, namely, a center O of the rotary shaft coupling portion 333 to the two contact points P11 and P12, respectively, is defined as a within the first compression chamber V2 just before discharge, the angle $\alpha$ at least just before the discharge is larger than about 360°, that is, $\alpha$<about 360°, and a distance l between normal vectors at the two contact points (P11, P12) also has a value greater than zero.

As a result, the first compression chamber immediately before the discharge may have a smaller volume as compared to a case where a fixed wrap and an orbiting wrap have a shape of an involute curve. Therefore, the compression ratios of the first and second compression chambers V1 and V2 may both be improved even without increasing sizes of the first wrap 323 and the second wrap 332.

On the other hand, as described above, the second scroll 33 may be orbitally provided between the frame 31 and the fixed scroll 32. An Oldham ring 35 that prevents rotation of the second scroll 33 may be provided between an upper surface of the second scroll 33 and a lower surface of the frame 31, and a sealing member or seal 36 for forming a back pressure chamber S1 discussed hereinafter may be provided at an inner side rather than the Oldham ring 35.

An intermediate pressure space may be formed by an oil feeding hole 321*a* provided on the second scroll 32 at an outside of the sealing member 36. The intermediate pressure space communicates with an intermediate compression chamber V, and thus, is filled with refrigerant of intermediate pressure, so as to serve as a back pressure chamber. Therefore, a back pressure chamber formed at an inside with respect to the sealing member 36 may be referred to as a "first back pressure chamber" S1, and an intermediate pressure space formed at an outside may be referred to as a "second back pressure chamber" S2. As a result, the back pressure chamber S1 is a space formed by a lower surface of the frame 31 and an upper surface of the second scroll 33 based on the sealing member 36, and will be described hereinafter along with the sealing member 36.

On the other hand, the passage separation unit 40 may be provided in the intermediate space 10*a*, which is a space formed between a lower surface of the motor unit 20 and an upper surface of the compression unit 30, to play the role of preventing refrigerant discharged from the compression unit 30 from interfering with oil flowing from the upper space 10*b* of the motor unit 20, which is an oil separation space, to the lower space 10*c* of the compression unit 30, which is an oil storage space.

The passage separation unit 40 according to this embodiment may include a passage guide that divides the first space

10*a* into a space through which refrigerant flows (hereinafter, referred to as a "refrigerant flow space") and a space through which oil flows (hereinafter, referred to as an "oil flow space"). The first space 10*a* may be divided into the refrigerant flow space and the oil flow space by only the passage guide, but according to circumstances, a plurality of passage guides may be combined to perform the role of the passage guide.

The passage separation unit 40 according to this embodiment may include a first passage guide 410 provided in the frame 31 and extending upward, and a second passage guide 420 provided in the stator 21 and extending downward. The first passage guide 410 and the second passage guide 420 may overlap each other in the axial direction to divide the intermediate space 10*a* into the refrigerant flow space and the oil flow space.

The first passage guide 410 may be formed in an annular shape and fixedly coupled to the upper surface of the frame 31. The second passage guide 420 may extend from an insulator, which may be inserted into the stator 21 to insulate winding coils.

The first passage guide 410 may include a first annular wall portion or wall 411 that extends upward from an outer side, a second annular wall portion or wall 412 that extends upward from an inner side, and an annular surface portion or surface 413 that extends in a radial direction to connect the first annular wall portion 411 and the second annular wall portion 412. The first annular wall portion 411 may be formed higher than the second annular wall portion 412, and the annular surface portion 413 may be provided with a refrigerant through hole formed from the compression unit 30 to the intermediate space 10*a* in a communicating manner.

A balance weight 26 may be located at an inside of the second annular wall portion 412, namely, in a rotary shaft direction, and coupled to the rotor 22 or the rotary shaft 50. Refrigerant may be stirred while the balance weight 26 rotates, but the second annular wall portion 412 may prevent the refrigerant from moving toward the balance weight 26 to suppress the refrigerant from being stirred by the balance weight 26.

The second flow guide 420 may include a first extending portion 421 that extends downward from the outside of the insulator, and a second extending portion 422 that extends downward from an inside of the insulator. The first extending portion 421 may overlap the first annular wall portion 411 in the axial direction to play a role of separating the refrigerant flow space from the oil flow space. The second extending portion 422 may not be formed as necessary. Even when it is formed, the second extending portion 422 may not overlap the second annular wall portion 412 in the axial direction, or may be formed at a sufficient distance from the second annular wall portion 412 in the radial direction, such that the refrigerant may sufficiently flow even if it overlaps the second annular wall portion 412.

An upper portion of the rotary shaft 50 may be press-fitted into a center of the rotor 22 while a lower portion thereof may be coupled to the compression unit 30 to be supported in the radial direction. Accordingly, the rotary shaft 50 transfers the rotational force of the motor unit 20 to the orbiting scroll 33 of the compression unit 30. Then, the second scroll 33 eccentrically coupled to the rotary shaft 50 performs an orbiting motion with respect to the first scroll 32.

The main bearing (hereinafter, referred to as a "first bearing") 51 may be formed at a lower portion of the rotary shaft 50 to be inserted into the first bearing hole 312*a* of the frame 31 and supported in the radial direction, and the sub-bearing (hereinafter, referred to as a "second bearing") 52 may be formed at a lower side of the first bearing 51 to be inserted into the second bearing hole 326*a* of the first scroll 32 and supported in the radial direction. The eccentric portion 53 may be provided between the first bearing 51 and the second bearing 52 in a manner of being inserted into the rotary shaft coupling portion 333.

The first bearing 51 and the second bearing 52 may be coaxially formed to have a same axial center, and the eccentric portion 53 may be eccentrically formed in the radial direction with respect to the first bearing 51 or the second bearing 52. The second bearing 52 may be eccentrically formed with respect to the first bearing 51.

The eccentric portion 53 should be formed in such a manner that its outer diameter is smaller than an outer diameter of the first bearing 51 and larger than an outer diameter of the second bearing 52 to be advantageous in coupling the rotary shaft 50 through the respective bearing holes 312*a* and 326*a* and the rotary shaft coupling portion 333. However, in a case in which the eccentric portion 53 is formed using a separate bearing without being integrally formed with the rotary shaft 50, the rotary shaft 50 may be inserted even when the outer diameter of the second bearing 52 is not smaller than the outer diameter of the eccentric portion 53.

An oil supply passage 50*a* that supplies oil to each bearing and the eccentric portion 53 may be formed within the rotary shaft 50 along the axial direction. As the compression unit 30 is located below the motor unit 20, the oil supply passage 50*a* may extend from a lower end of the rotary shaft 50 to approximately a lower end or a middle height of the stator 21 or a position higher than an upper end of the first bearing 31. The oil supply passage may be in the form of a groove. Of course, according to circumstance, the oil supply passage 50*a* may also be formed by penetrating through the rotary shaft 50 in an axial direction.

An oil feeder 60 that pumps up oil filled in the lower space 10*c* may be coupled to the lower end of the rotary shaft 50, namely, a lower end of the second bearing 52. The oil feeder 60 may include an oil supply pipe 61 inserted into the oil supply passage 50*a* of the rotary shaft 50, and a blocking member 62 that blocks introduction of foreign materials by receiving the oil supply pipe 61 therein. The oil supply pipe 61 may be immersed in oil of the lower space 10*c* through the discharge cover 34.

As illustrated in FIG. 3, a sliding portion oil supply path F1 connected to the oil supply passage 50*a* to supply oil to each sliding portion is formed in each bearing 51 and 52 and the eccentric portion 53 of the rotary shaft 50. The sliding portion oil supply path F1 may include a plurality of oil supply holes 511, 521 and 531 formed through the oil supply passage 50*a* toward an outer circumferential surface of the rotary shaft 50, and a plurality of oil supply grooves 512, 522 and 532 that communicates with the oil supply holes 511, 521 and 531, respectively, to lubricate each bearing 51, 52 and the eccentric portion 53.

For example, a first oil supply hole 511 and a first oil supply groove 512 may be formed in the first bearing 51, and a second oil supply hole 521 and a second oil supply groove 522 may be formed in the second bearing 52. A third oil supply hole 531 and a third oil supply groove 532 may be formed in the eccentric portion 53. Each of the first oil supply groove 512, the second oil supply groove 522, and the third oil supply groove 532 may be formed in a slot shape extending in the axial direction or an inclined direction.

A first connection groove 541 and a second connection groove 542 each formed in an annular shape may be formed between the first bearing 51 and the eccentric portion 53 and between the eccentric portion 53 and the second bearing 52, respectively. The first connection groove 541 may communicate with a lower end of the first oil supply groove 512, and the second oil supply groove 522 may be connected with the second connection groove 542. Accordingly, a portion of oil that lubricates the first bearing 51 through the first oil supply groove 512 may flow down to be collected into the first connection groove 541, and then introduced into the first back pressure chamber S1, thereby forming back pressure of discharge pressure. Oil that lubricates the second bearing 52 through the second oil supply groove 522 and oil that lubricates the eccentric portion 53 through the third oil supply groove 532 may be collected into the second connection groove 542, and then introduced into the compression unit 30 through a space between a front end surface of the rotary shaft coupling portion 333 and the first disk portion 321.

A small amount of oil suctioned up toward an upper end of the first bearing 51 may flow out of a bearing surface from an upper end of the first bearing portion 312 of the frame 31 and flow down toward an upper surface 31*a* of the frame 31 along the first shaft bearing portion 312. Afterwards, the oil may be collected into the lower space 10*c* through the oil passages $P_{O1}$ and $P_{O2}$ consecutively formed on an outer circumferential surface of the frame 31 (or a groove that communicates from the upper surface to the outer circumferential surface) and an outer circumferential surface of the first scroll 32.

Moreover, oil discharged from the compression chamber V to the upper space 10*b* of the casing 10 together with refrigerant may be separated from the refrigerant in the upper space 10*b* of the casing 10 and collected into the lower space 10*c* through the first oil passage $P_{O1}$ formed on an outer circumferential surface of the motor unit 20 and the second oil passage $P_{O2}$ formed on an outer circumferential surface of the compression unit 30. The passage separation unit 40 may be provided between the motor unit 20 and the compression unit 30. Accordingly, oil which is separated from refrigerant in the upper space 10*b* may flow toward the lower space 10*c* along the passages $P_{O1}$ and $P_{O2}$, without being re-mixed with refrigerant which is discharged from the compression unit 20 and flow toward the upper space 10*b*, and the refrigerant moving toward the upper surface 10*b* may flow toward the upper pace 10*b* along the passages $P_{G1}$ and $P_{G2}$.

The second scroll 33 may be provided with a compression chamber oil supply path F2 that supplies oil suctioned up through the oil supply passage 50*a* into the compression chamber V. The compression chamber oil supply path F2 may be connected to the sliding portion oil supply path F1.

The compression chamber oil supply path F2 may include a first oil supply path 371 that communicates the oil supply passage 50*a* with the second back pressure chamber S2 forming an intermediate pressure space, and a second oil supply path 372 that communicates the second back pressure chamber S2 with the intermediate pressure chamber of the compression chamber V.

Of course, the compression chamber oil supply path F2 may also be formed to communicate directly with the intermediate pressure chamber V from the oil supply passage 50*a* without passing through the second back pressure chamber S2. In this case, however, a refrigerant passage that communicates the second back pressure chamber S2 with the intermediate pressure chamber V should be separately provided, and an oil passage to supply oil to the Oldham ring 35 located in the second back pressure chamber S2 should be separately provided. This causes an increase in a number of passages and complicates processing. Therefore, even in order to reduce the number of passages or paths by unifying the refrigerant passage and the oil passage, as described in this embodiment, the oil supply passage 50*a* may communicate with the second back pressure chamber S2 and the second back pressure chamber S2 with the intermediate pressure chamber V.

The first oil supply path 371 may be provided with a first orbiting passage portion 371*a* formed from an upper surface down to a middle of the second disk portion 331 in a thickness direction, a second orbiting passage portion 371*b* formed from the first orbiting passage portion 371*a* toward an outer circumferential surface of the second disk portion 331, and a third orbiting passage portion 371*c* formed through the upper surface of the second disk portion 331 from the second orbiting passage portion 371*b*.

The first orbiting passage portion 371*a* may be located at a position belonging to the first back pressure chamber S1, and the third orbiting passage portion 371*c* may be located at a position belonging to the second back pressure chamber S2. Further, a pressure reducing rod 375 may be inserted into the second orbiting passage portion 371*b* to reduce pressure of oil which flows from the first back pressure chamber S1 to the second back pressure chamber S2 through the first oil supply passage 371. Accordingly, a sectional area of the second orbiting passage portion 371*b* excluding the pressure reducing rod 375 may be smaller than a sectional area of the first orbiting passage portion 371*a* or the third orbiting passage portion 371*c*.

In a case in which an end portion or end of the third orbiting passage portion 371*c* is formed to be located at an inside of the Oldham ring 35, namely, between the Oldham ring 35 and the sealing member 36, oil flowing through the first oil supply passage 371 may be blocked by the Oldham ring 35, and thus, may not smoothly flow to the second back pressure chamber S2. Therefore, in this case, a fourth orbiting passage portion 371*d* may be formed from the end portion of the third orbiting passage portion 371*c* toward an outer circumferential surface of the second disk portion 331. The fourth orbiting passage portion 371*d* may be formed as a groove on an upper surface of the second disk portion 331, as illustrated in FIG. 4, or may be formed as a hole within the second disk portion 331.

The second oil supply passage 372 may include a first fixed passage portion 372*a* extending in the second sidewall portion 322 in a thickness direction, a second fixed passage portion 372*b* that extends from the first fixed passage portion 372*a* in the radial direction, and a third fixed passage portion 372*c* that provides communication between the second fixed passage portion 372*b* and the intermediate pressure chamber V.

In the drawings, unexplained reference numeral 70 denotes an accumulator.

A lower compression type scroll compressor according to embodiments may operate as follows.

When power is applied to the motor unit 20, a rotational force may be generated and the rotor 21 and the rotary shaft 50 may be rotated by the rotational force. As the rotary shaft 50 rotates, the orbiting scroll 33 eccentrically coupled to the rotary shaft 50 may perform an orbiting motion due to the Oldham ring 35.

Then, refrigerant supplied from an outside of the casing 10 through the refrigerant suction pipe 15 may be introduced into the compression chamber V, and compressed as a volume of the compression chamber V is reduced by the orbiting motion of the orbiting scroll 33. The refrigerant may then be discharged into an inner space of the discharge cover 34 through the first discharge port 325*a* and the second discharge port 325*b*.

Then, noise may be reduced from the refrigerant discharged into the inner space of the discharge cover 34 while the refrigerant circulates within the inner space of the discharge cover 34. The noise-reduced refrigerant may flow to a space between the frame 31 and the stator 21, and then be introduced into an upper space of the motor unit 20 through a gap between the stator 21 and the rotor 22.

Oil may be separated from the refrigerant in the upper space of the motor unit 20. Accordingly, the refrigerant may be discharged out of the casing 10 through the refrigerant discharge pipe 16, while the oil is collected back into the lower space 10*c* as the oil storage space of the casing 10 through a passage between the inner circumferential surface of the casing 10 and the stator 21 and a passage between the inner circumferential surface and the outer circumferential surface of the compression unit 30. This series of processes may be repeated.

The oil in the lower space 10*c* may be suctioned up through the oil supply passage 50*a* of the rotary shaft 50, so as to lubricate the first bearing 51, the second bearing 52, and the eccentric portion 53 through the oil supply holes 511, 521 and 531 and the oil supply grooves 512, 522 and 532, respectively. Oil that lubricates the first bearing 51 through the first oil supply hole 511 and the first oil supply groove 512 may be collected into the first connection groove 51 between the first bearing 51 and the eccentric portion 53, and then introduced into the first back pressure chamber S1. This oil may form a substantial discharge pressure, and thus, the first back pressure chamber S1 may also be filled with substantial discharge pressure. Therefore, a center portion or center of the second scroll 33 may be supported by the discharge pressure in the axial direction.

On the other hand, the oil in the first back pressure chamber S1 may be moved to the second back pressure chamber S2 through the first oil supply passage 371 due to a pressure difference from the second back pressure chamber S2. The pressure reducing rod 375 provided in the second orbiting passage portion 371*b* forming the first oil supply passage 371 may allow pressure of the oil flowing toward the second back pressure chamber S2 to be reduced to an intermediate pressure.

In addition, the oil flowing to the second back pressure chamber (intermediate pressure space) S2 may support an edge portion or edge of the second scroll 33 and simultaneously move to the intermediate pressure chamber V through the second oil supply passage 372 due to a pressure difference from the intermediate pressure chamber V. However, when the pressure of the intermediate pressure chamber V becomes higher than the pressure of the second back pressure chamber S2 during the operation of the compressor, refrigerant may flow from the intermediate pressure chamber V to the second back pressure chamber S2 through the second oil supply passage 372. In other words, the second oil supply passage 372 plays a role of a passage through which the refrigerant and the oil alternatively flow according to the pressure difference between the second back pressure chamber S2 and the intermediate pressure chamber V.

In the shaft-through scroll compressor, as a final compression chamber communicating with the discharge port is formed at a position eccentric from the center of the first scroll as described above, it is very difficult to form a discharge port through which the refrigerants compressed in the first compression chamber and the second compression chamber are simultaneously discharged. In consideration of this, the first discharge port communicating with the first compression chamber and the second compression chamber communicating with the second compression chamber are formed, respectively. Refrigerant compressed in the first compression chamber is discharged through the first discharge port, and refrigerant compressed in the second compression chamber is discharged through the second discharge port.

Accordingly, the first discharge port and the second discharge port may be appropriately positioned, to prevent an over-compression loss in advance in each discharge port even though the first compression chamber and the second compression chamber have different compression gradients from each other. In addition, as the first discharge port and the second discharge port have appropriate sizes in consideration of the compression ratio of the refrigerant compressed in the first compression chamber and the compression ratio of the refrigerant compressed in the second compression chamber, thereby more effectively preventing the over-compression loss due to the discharge delay.

FIGS. 5 to 12 are views of the first scroll for explaining the first discharge port and the second discharge port according to an embodiment. As illustrated in those drawings, the first discharge port 325*a* according to this embodiment is formed through the first disk portion 321 in a thickness direction of the first disk portion 321 at a position spaced apart from an inner end (wrap start end) of the first wrap 323 by a predetermined interval along an inner circumferential surface of the first wrap 323. For example, the first discharge port 325*a* may be formed adjacent to a contact portion 328*a*, which is brought into contact with the concave portion 335 of the second wrap 332 of the protruding portion 328 of the first wrap 323. Accordingly, the refrigerant compressed in the first compression chamber V1 is discharged while the first discharge port 325*a* is opened in advance before the refrigerant flows up to the inner end of the first wrap 323. This may result in advancing a discharge start time point toward a suction side while ensuring a wide area of the discharge port.

Further, the first discharge port 325*a* may be formed to have a large sectional area at its inlet side, if possible, to minimize discharge resistance. However, when the inlet (hereinafter, referred to as a "first discharge inlet portion" or "first discharge inlet") 385*a* of the first discharge port 325*a* is formed too large and becomes too close to the second bearing hole 326*a*, the first discharge inlet portion 385*a* is blocked by an increasing portion 335*a* formed on the rotary shaft coupling portion 333 of the second scroll 33. As a result, the first discharge port 325*a* may fail to sufficiently serve as a discharge port or communicate with an inner circumferential portion of the rotary shaft coupling portion 333, such that compressed refrigerant is leaked into the inner circumferential portion of the rotary shaft coupling portion 333, thereby lowering compression efficiency.

In view of this, the first discharge port 385*a* may be formed to have a sectional area as large as possible without being blocked by the second scroll 33 or communicating with the inner circumferential portion of the rotary shaft coupling portion 333. For this, the first discharge inlet portion 385*a* may not have a circular cross section, but rather, may be formed in a slit shape along a direction that the first wrap 323 is formed.

Figure 6:
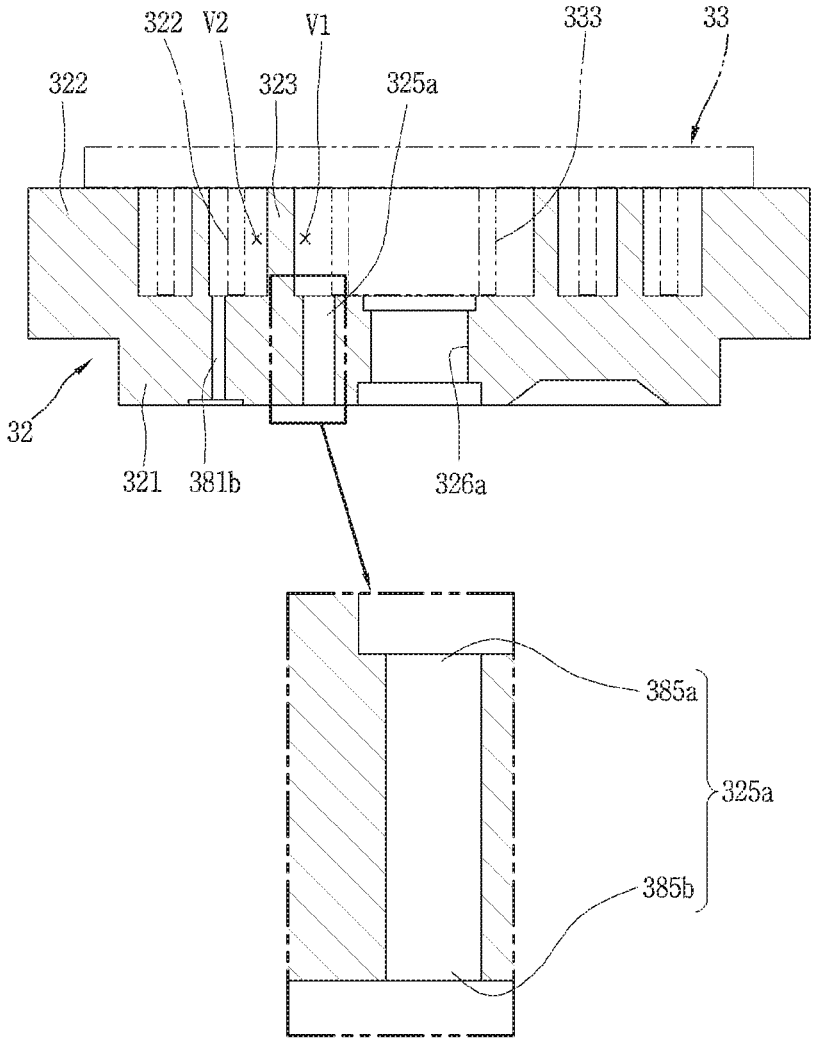
FIG. 6 is a cross-sectional view taken along the line "VI-VI" of FIG. 5 for explaining a first discharge port in the first scroll according to an embodiment.
Figure 7:
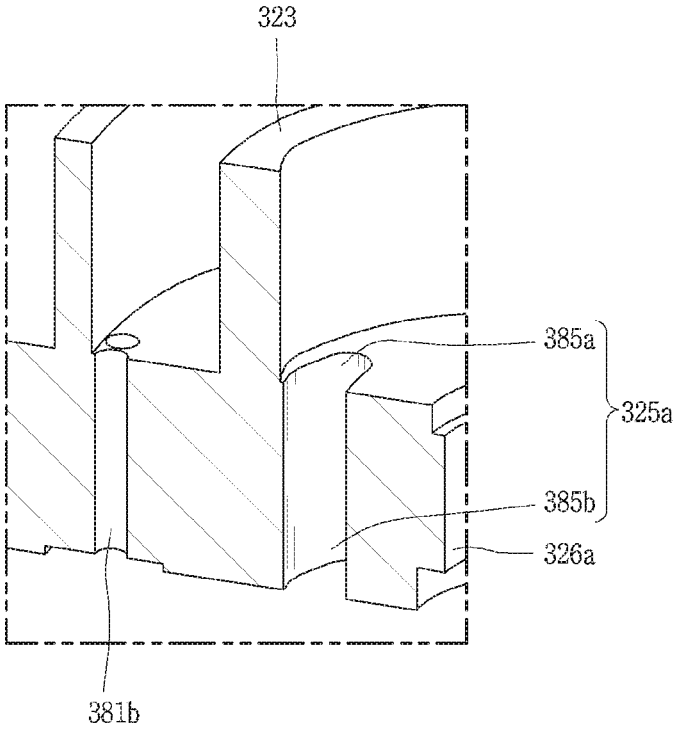
FIG. 7 is an enlarged perspective view of the first discharge port in FIG. 6.
Figure 8:
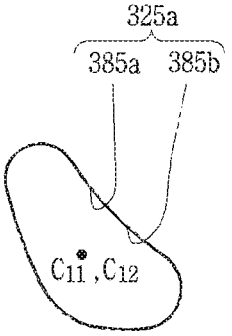
FIG. 8 is a schematic view illustrating a first discharge inlet and a first discharge outlet of the first discharge port in FIG. 6.

On the other hand, an outlet (hereinafter, referred to as a "first discharge outlet portion" or "first discharge outlet") 385*b* of the first discharge port 325*a* may also have a circular cross section. However, in this case, the first discharge inlet portion 385*a* and the second discharge outlet portion 385*b* have different shapes from each other, which may be disadvantageous from the perspective of processing. Therefore, in this embodiment, as illustrated in FIGS. 6 to 8, it may be advantageous from the perspective of processing that the first discharge outlet portion 385*b* is formed in the same shape as the first discharge inlet portion 385*a*, that is, in the slit shape.

In this case, in order to reduce the flow resistance at the first discharge port 325*a*, it may be advantageous that a sectional area of the first discharge outlet portion 385*b* is larger than that of the first discharge inlet portion 385*a*. However, when the first discharge inlet portion 385*a* and the first discharge outlet portion 385*b* have different sectional areas from each other, an additional process is disadvantageously required in terms of processing. Therefore, it may be advantageous from the perspective of processing that the first discharge inlet portion 385*a* and the first discharge outlet portion 385*b* have the same sectional area.

Figure 12:
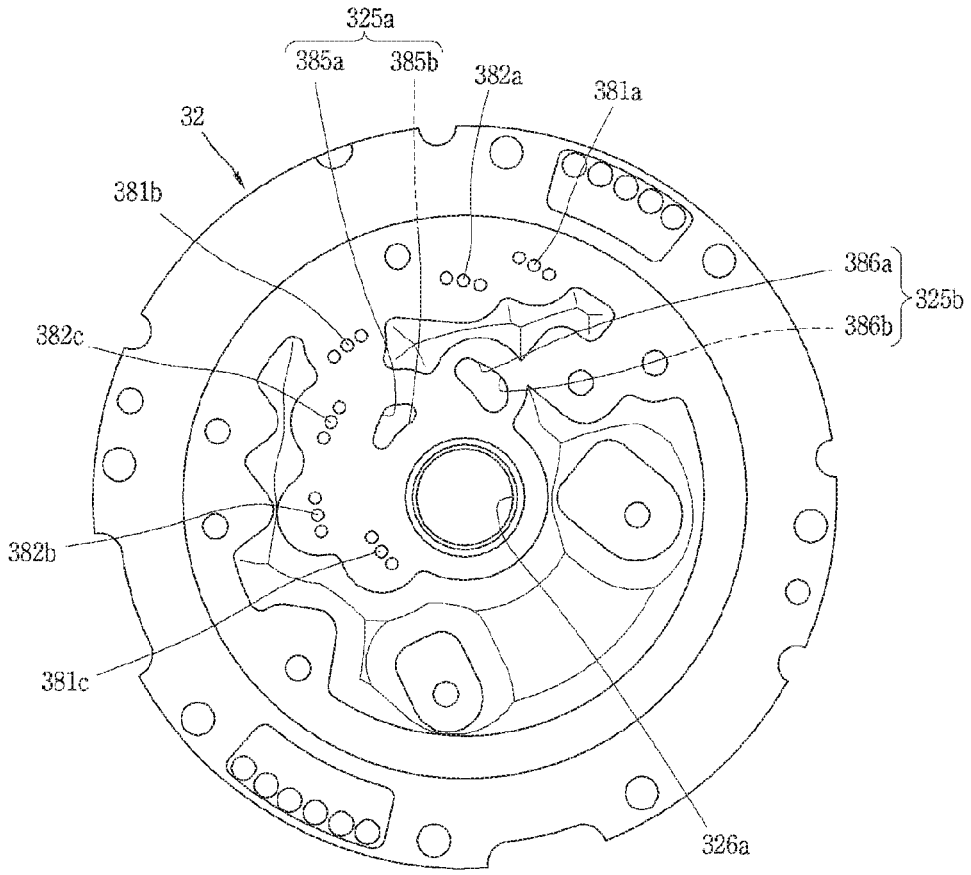
FIG. 12 is a planar view of the first scroll according to an embodiment, viewed from a bottom surface.

The first discharge inlet portion 385*a* and the second discharge outlet portion 385*b* may be formed in a manner that geometric centers $C_{11}$ and $C_{12}$ thereof are concentrically located. For example, even if the first and second discharge inlet and outlet portions 385*a* and 385*b* have a same cross section and a same sectional area, when the geometric centers thereof are different from each other, the number of processing may be increased accordingly. Therefore, the first discharge inlet portion 385*a* and the second discharge outlet portion 385*b* may be completely coincided (aligned) in the axial direction so that their geometrical centers $C_{11}$ and $C_{12}$ are concentrically positioned. However, as the first discharge outlet portion 385*b* may be formed in the slit shape, similar to the first discharge inlet portion 385*a*, as illustrated in FIG. 12, the first discharge outlet portion 385*b* may be limited in size and position to avoid interference with structures or components adjacent thereto.

Figure 5:
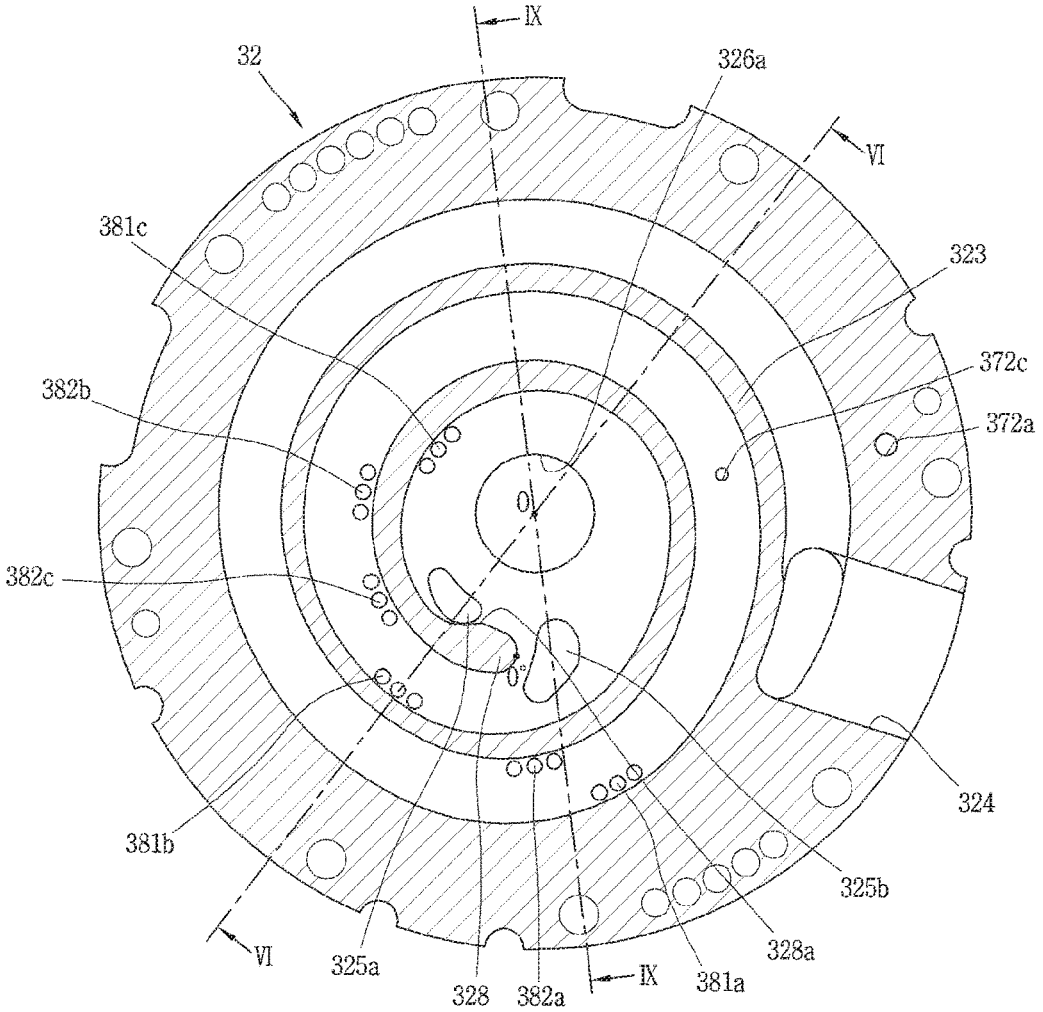
FIG. 5 is a planar cross-sectional view of a first scroll according to an embodiment, viewed from a top surface.
Figure 9:
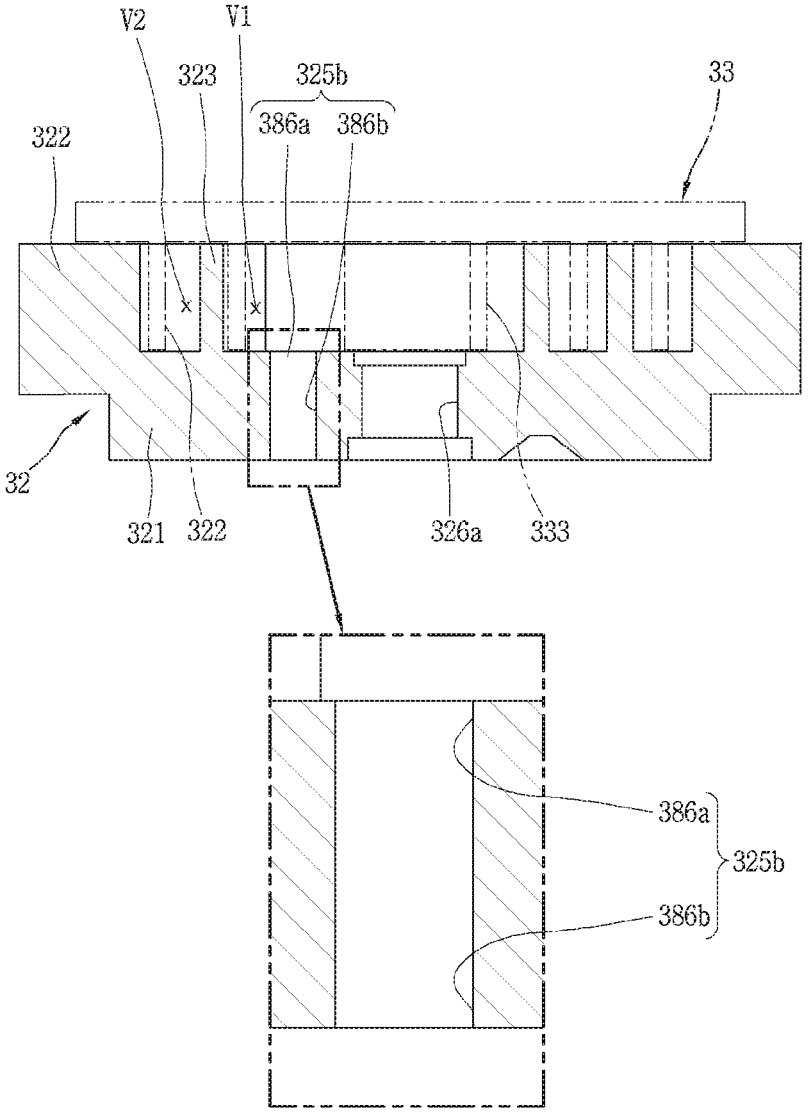
FIG. 9 is a cross-sectional view taken long the line "IX-IX" of FIG. 5 for explaining a second discharge port in the first scroll according to an embodiment.
Figure 10:
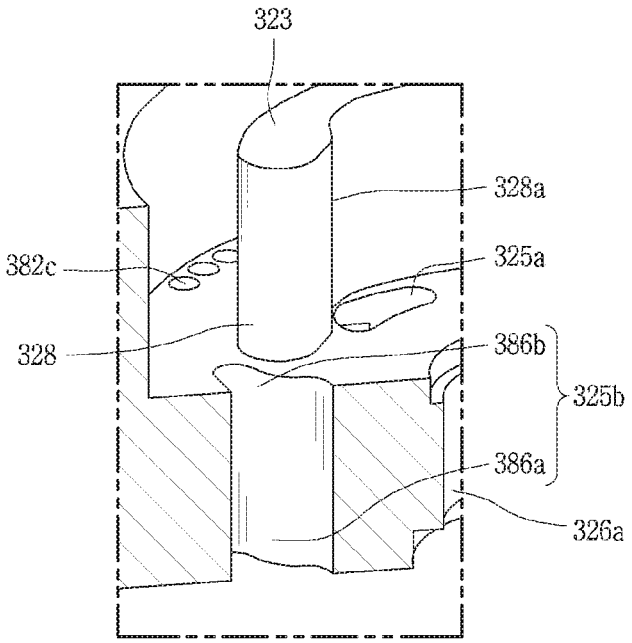
FIG. 10 is an enlarged perspective view of the second discharge port in FIG. 9.
Figure 11:
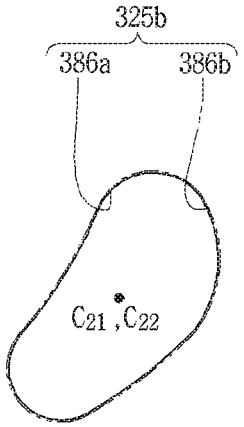
FIG. 11 is a schematic view illustrating a second discharge inlet and a second discharge outlet of the second discharge port in FIG. 9.

As illustrated in FIG. 5, the second discharge port 325*b* may be formed through the first disk portion 321 in the thickness direction of the first disk portion 321 at a position spaced apart from the inner end (the wrap start end) of the first wrap 323 by a predetermined interval. The second discharge port 325*b*, similar to the first discharge port 325*a*, may have a cross section as large as possible to minimize discharge resistance. However, when an inlet (hereinafter, referred to as a "second discharge inlet portion" or "second discharge inlet") 386*a* of the second discharge port 325*b* is formed too large and becomes too close to the second bearing hole 326*a*, the second discharge inlet portion 386*a* is blocked by the arcuate compression surface 335*a* connected to the rotatory shaft coupling portion 333 of the second scroll 33. As a result, the second discharge port 325*b* may fail to sufficiently serve as a discharge port or communicate with an inner circumferential portion of the rotatory shaft coupling portion 333, thereby causing a compression loss. In view of this, as illustrated in FIGS. 9 to 11, the second discharge inlet portion 386*a* may be formed to have a noncircular cross section, such as a slit shape or a triangular shape, similar to the first discharge inlet portion 385*a*, so as to ensure a sectional area as large as possible without being blocked by the second scroll 33 or communicating with the rotatory shaft coupling portion 333.

The second discharge outlet portion 386*b* may be formed in a noncircular sectional shape so as to have the same cross section and the same sectional area as the second discharge inlet portion 386*a*. The geometric center $C_{21}$ of the second discharge inlet portion 386*a* and the geometric center $C_{22}$ of the second discharge outlet portion 386*b* may also be made to coincide with each other.

As described above, the scroll compressor in which the first discharge port and the second discharge port communicate with the first compression chamber and the second compression chamber, respectively, has at least the following effects.

That is, as described above, refrigerants compressed in the first compression chamber V1 and the second compression chamber V2 flow into the inner space of the discharge cover 34 from the compression chambers through the first discharge port 325*a* and the second discharge port 325*b*, respectively. At this time, as the second discharge port 325*b* is open earlier than the first discharge port 325*a*, discharge resistances to the refrigerant discharged from the first compression chamber V1 and the refrigerant discharged from the second compression chamber V2 may be minimized. Accordingly, a compression loss in the first compression chamber V1 or the second compression chamber V2 may be prevented, and thus, compressor efficiency may be increased.

In the first compression chamber V1, the first discharge inlet portion 385*a* extends in the slit shape along the forming direction of the first wrap 323 so that the sectional area of the first discharge inlet portion 385*a* may increase. As a result, the area of the first discharge port may be enlarged to reduce a flow rate of refrigerant discharged, and an over-compression in the first discharge port may be suppressed by virtue of the reduced flow rate of the refrigerant. That is, in the first compression chamber V1, the first discharge inlet portion 385*a* extends in the slit shape along the forming direction of the first wrap 323 so that the sectional area of the first discharge inlet portion 385*a* can increase and the discharge start point of the first discharge port 325*a* may be drawn to a front side, that is, toward the suction side. Accordingly, a discharge delay in the first compression chamber V1 may be prevented beforehand, and thus, a compression loss due to over-compression may be prevented more effectively.

The second compression chamber V2 has a relatively larger compression gradient than the first compression chamber V1. Therefore, a flow rate of the refrigerant is faster in the second compression chamber V2. However, as the second discharge inlet portion 386*a* is wider than the first discharge inlet portion 385*a*, the flow rate of the refrigerant is reduced while refrigerant compressed in the second compression chamber V2 is discharged through the second discharge port 325*b*, thereby preventing an over-compression loss at the second discharge port. In addition, the discharge start point may be drawn toward the suction side while increasing the sectional area of the second discharge port 325*b*.

The first discharge inlet portion 385*a* and the first discharge outlet portion 386*a* may have the same cross section and the second discharge inlet portion 386*a* and the second discharge outlet portion 386*b* may have the same cross section, which may facilitate processing for the first discharge port and the second discharge port. Not only the first discharge inlet portion 385*a* and the first discharge outlet portion 385*b* but also the second discharge inlet portion 386*a* and the second discharge outlet portion 386*b* may also be formed to have the noncircular cross section and the same sectional area. In this case, although the first discharge port 325*a* and the second discharge port 325*b* are not circular, they have the same shape or sectional area from the inlet to outlet of the first discharge port 325*a* and from the inlet to outlet of the second discharge port 325*b*. Accordingly, the refrigerant compressed in each of the compression chambers may be rapidly discharged, thereby suppressing compression loss and improving processability for each discharge port.

Hereinafter, description will be given of discharge ports of a scroll compressor according to another embodiment.

Figure 13A:
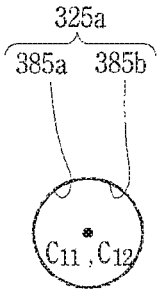
FIGS. 13A and 13B are schematic views of a first discharge port and a second discharge port according to the another embodiment.
Figure 13B:
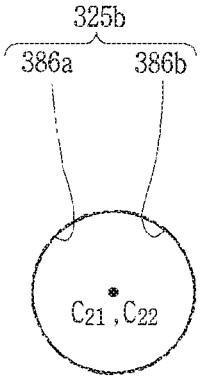

That is, the previous embodiment illustrates that both the second discharge inlet portion and the second discharge outlet portion forming the second discharge port as well as the first discharge inlet portion and the first discharge outlet portion forming the first discharge port have the noncircular cross section. However, this embodiment, as illustrated in FIGS. 13A and 13B, illustrates that the second discharge inlet portion 386*a* and the second discharge outlet portion 386*b* forming the second discharge port 325*b* as well as the first discharge inlet portion 385*a* and the first discharge outlet portion 385*b* forming the first discharge port 325*a* all have the circular cross section.

The first discharge inlet portion 385*a* and the first discharge outlet portion 385*b* may have the same sectional area and the same geometric center, similar to the aforementioned noncircular first discharge port 325*a*, and the second discharge inlet portion 386*a* and the second discharge outlet portion 386*b* may also have the same sectional area and the same geometric center, similar to the aforementioned noncircular second discharge port 325*b*. The first discharge inlet portion 385*a* may have a larger sectional area than the second discharge inlet portion 386*a* and the first discharge outlet portion 385*b* may have a larger sectional area than the second discharge outlet portion 386*b*. Accordingly, flow resistance in the second compression chamber having a relatively large compression ratio may be reduced, thereby suppressing compression loss.

As operation effects of the discharge ports according to this embodiment are the same as or similar to those of the previous embodiment, a detailed description thereof has been omitted. However, in this embodiment, as the inlet and outlet portions of each of the first discharge port 325*a* and the second discharge port 325*b* have the same cross section and the same sectional area, processability for the first discharge port 325*a* and the second discharge port 325*b* may be further enhanced.

Hereinafter, description will be given of discharge ports of a scroll compressor according to another embodiment.

Figure 14A:
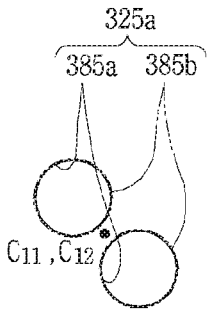
FIGS. 14A and 14B are schematic views of a first discharge port and a second discharge port according to another embodiment.
Figure 14B:
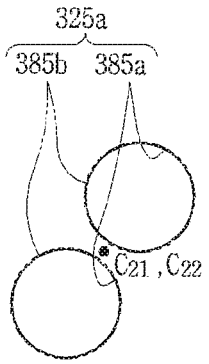

That is, the previous embodiments have illustrated that each of the first discharge port and the second discharge port are formed as one hole. However, this embodiment illustrates that at least one of the first discharge port 325*a* and the second discharge port 325*b* for the respective compression chambers V1 and V2 are provided with a plurality holes disposed adjacent to one another. For reference, as illustrated in FIGS. 14A and 14B, an embodiment in which the first discharge port is formed as a plurality of holes will be described as a representative example.

As illustrated, the first discharge inlet portion 385*a* and the first discharge outlet portion 385*b* forming the first discharge port 325*a* may be formed in a manner that a plurality of holes is spaced apart from one another by a predetermined interval. The plurality of holes may be arranged in various shapes according to their sizes and shapes. However, as illustrated in FIG. 14A, the plurality of holes may be linearly arranged along the forming direction of the first wrap 323, similar to the bypass holes 381 and 382. Of course, in some cases, those holes may be arranged into a triangular shape or more holes may also be arranged into a rectangular or ring shape.

The plurality of holes forming the first discharge inlet portion 385*a* and the first discharge outlet portion 385*b* may have the same cross section and the same sectional area along their arranged direction. Alternatively, the plurality of holes may have different cross sections and sectional areas from each other. However, the plurality of holes forming the first discharge inlet portion 385*a* and the plurality of holes forming the first discharge outlet portion 385*b* corresponding to each other may have the same cross section and the same sectional area.

When the plurality of holes is formed to have different sectional areas along the arranged direction, the holes may be larger toward the inner end (discharge end) of the first wrap 323 to increase compression efficiency. As the operation effects of the discharge ports according to this embodiment are the same as or similar to those of the previous embodiment, a detailed description thereof has been omitted. In this embodiment, although the number of processes is increased because the first discharge port 381 is formed as the plurality of holes, as the first discharge inlet portion 385*a* and the first discharge outlet portion 385*b* have the same sectional area, the first discharge inlet portion 385*a* and the first discharge outlet portion 385*b* may be formed through a single drilling process, thereby improving processability.

Also, as the plurality of holes of the first discharge port are arranged along the forming direction of the first wrap 323, a range of the first discharge port 325*a* may be extended, and thus, a discharge start time point may be further shortened, thereby preventing compression loss.

Embodiments disclosed herein provide a scroll compressor, capable of preventing over-compression loss with respect to a discharged refrigerant, in a manner of separating discharge paths such that refrigerants of a first compression chamber and a second compression chamber may be smoothly discharged. Embodiments disclosed herein also provide a scroll compressor, capable of preventing a compression loss due to over-compression, in a manner that refrigerant of a compression chamber having a relatively great (compression) gradient may be quickly and smoothly discharged.

Embodiments disclosed herein further provide a scroll compressor, capable of preventing a compression loss due to over-compression at a discharge port, in a manner of enlarging an actual sectional area of a discharge port by optimizing a shape of the discharge port according to a condition of each compression chamber. Embodiments disclosed herein additionally provide a scroll compressor which may be advantageous in view of processability while minimizing a compression loss according to a shape of the discharge port.

Embodiments disclosed herein provide a scroll compressor having a plurality of compression chambers with different compression gradients or volume reduction slopes, each of the compression chambers having a discharge port. At least one of the discharge ports may be formed such that a discharge inlet portion and a discharge outlet portion have a same sectional area.

A scroll compressor may be provided in accordance with embodiments in which a discharge port formed in a compression chamber having a larger compression gradient or volume reduction slope of the plurality of discharge ports has a larger sectional area than a discharge port formed in another compression chamber.

A scroll compressor according to embodiments disclosed herein may include a first compression chamber, a second compression chamber separated from the first compression chamber, and having a greater compression ratio than the first compression chamber, a first discharge port that communicates with the first compression chamber and provided with a first discharge inlet portion or inlet and a first discharge outlet portion or outlet, and a second discharge port separated from the first discharge port, that communicates with the second compression chamber, and provided with a second discharge inlet portion or inlet and a second discharge outlet portion or outlet, the second discharge inlet portion having a larger sectional area than the first discharge inlet portion. The first discharge inlet portion and the first discharge outlet portion may have a same cross section, and the second discharge inlet portion and the second discharge outlet portion may have a same cross section. At least one of the first discharge port or the second discharge port may be formed in a manner that the discharge inlet portion and the discharge outlet portion have the same cross section. At least one of the first discharge port or the second discharge port may have a noncircular cross section. At least one of the first discharge port or the second discharge port may have a circular cross section. At least one of the first discharge port or the second discharge port may be provided with a plurality of holes.

A scroll compressor according to another embodiment may include a first scroll having a first wrap formed on one or a first surface of a first disk portion or disk, and provided with a first discharge port and a second discharge port formed through the first disk portion in a thickness direction in a vicinity of an inner end of the first wrap, the first discharge port and the second discharge portion being eccentric from a center of the first disk portion, a second scroll having a second wrap formed on one or a second surface of a second disk portion or disk and engaged with the first wrap, an outer surface of the second wrap forming a first compression chamber together with an inner surface of the first wrap and an inner surface of the second wrap forming a second compression chamber together with an outer surface of the first wrap while the second scroll orbits with respect to the first scroll, the first compression chamber and the second compression chamber communicating with the first discharge port and the second discharge port, respectively, and a rotatory shaft having an eccentric portion coupled through the second scroll to overlap the second wrap in the radial direction. A discharge inlet portion or inlet and a discharge outlet portion or outlet of the first discharge port have a same sectional area, and a discharge inlet portion or inlet and a discharge outlet portion or outlet of the second discharge port have a same sectional area.

A time point at which the second discharge port is open with respect to the second compression chamber may be earlier than a time point at which the first discharge port is open with respect to the first compression chamber. The first discharge port and the second discharge port may have a same cross section. The first discharge port and the second discharge port may have different cross sections from each other. The second discharge port may have a larger sectional area than the first discharge port.

A scroll compressor according to another embodiment may include a casing having an inner space storing oil therein, a drive motor provided in the inner space of the casing, a rotary shaft coupled to the drive motor, a frame provided below the drive motor, a first scroll provided below the frame, having a first wrap formed on one or a first surface of a first disk portion or disk, and provided with a first discharge port and a second discharge port spaced apart from each other by a predetermined interval in a vicinity of an inner end of the first wrap, and a second scroll provided between the frame and the first scroll, having a second wrap formed on one or a first surface of a second disk portion or disk and engaged with the first wrap, the rotary shaft being eccentrically coupled to the second wrap to overlap the second wrap in a radial direction, the second scroll forming a first compression chamber and a second compression chamber together with the first scroll while performing an orbiting motion with respect to the first scroll. The first discharge port may be provided with a first discharge inlet portion or inlet and a first discharge outlet portion or outlet formed toward a lower surface of the first scroll within the first compression chamber and communicating with each other, and the second discharge port may be provided with a second discharge inlet or inlet portion and a second discharge outlet portion or outlet formed toward a lower surface of the first scroll within the second compression chamber and communicating with each other. The first discharge outlet portion and the first discharge inlet portion may have a same sectional area, and the second discharge outlet portion and the second discharge inlet portion may have a same sectional area. The second discharge inlet portion may have a larger sectional area than the first discharge inlet portion.

Each of the first discharge inlet portion and the first discharge outlet portion may have a noncircular cross section, and each of the second discharge inlet portion and the second discharge outlet portion may have a noncircular cross section. Each of the first discharge inlet portion and the first discharge outlet portion may have a circular cross section, and each of the second discharge inlet portion and the second discharge outlet portion may have a circular cross section. Each of the first discharge inlet portion and the first discharge outlet portion may be provided with a plurality of holes, and the second discharge inlet portion and the second discharge outlet portion may be provided with one hole.

A time point at which the second discharge port is open with respect to the second compression chamber may be earlier than a time point at which the first discharge port is open with respect to the first compression chamber.

The first discharge port and the second discharge port may have a same cross section. A geometric center of each discharge inlet portion and a geometric center of each discharge outlet portion of the first discharge port and the second discharge port may be located on a same line.

The first scroll may be provided with a plurality of bypass portions or bypasses with predetermined intervals along a moving path of each of the first compression chamber and the second compression chamber. The bypass portions adjacent to the second discharge port, among the bypass portions formed in the second compression chamber, may have a shortest interval therebetween.

In such a manner, a scroll compressor according to embodiments disclosed herein may separately be provided with a discharge port of a first compression chamber and a discharge port of a second compression chamber, to allow a smooth flow of refrigerant in each compression chamber, thereby preventing over-compression loss due to a discharge delay. Also, a scroll compressor according to embodiments disclosed herein may be configured in a manner that a discharge port of a compression chamber having a large compression gradient is larger than a discharge port of a compression chamber having a small compression gradient, such that refrigerant of the compression chamber having the relatively large compression gradient may be discharged quickly and smoothly. This may result in preventing an over-compression loss more effectively.

A scroll compressor according to embodiments disclosed herein may be configured in a manner that a shape of an inlet portion or inlet of a discharge port communicating with each compression chamber is optimized according to a condition of the compression chamber, such that refrigerant in each compression chamber may be discharged quickly and smoothly, which may result in preventing over-compression loss at a discharge port. In addition, a scroll compressor according to embodiments disclosed herein may be configured in a manner that each discharge port has a same shape from inlet to outlet. Accordingly, each discharge port may be formed to have various cross sections, such as a noncircular shape as well as a circular shape, and simultaneously deterioration of processability thereof may be prevented.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a first compression chamber;

a second compression chamber separated from the first compression chamber, and having a greater compression ratio than the first compression chamber;

a first discharge port that communicates with the first compression chamber and provided with a first discharge inlet and a first discharge outlet; and a second discharge port separated from the first discharge port, that communicates with the second compression chamber, and provided with a second discharge inlet and a second discharge outlet, the second discharge inlet having a larger sectional area than the first discharge inlet, wherein the first discharge inlet and the first discharge outlet have a same cross section shape, and the second discharge inlet and the second discharge outlet have a same cross section shape.

2. The compressor of claim 1, wherein the discharge inlet and the discharge outlet of at least one of the first discharge port or the second discharge port have a same sectional area.

3. The compressor of claim 2, wherein at least one of the first discharge port or the second discharge port has a noncircular cross section shape.

4. The compressor of claim 2, wherein at least one of the first discharge port or the second discharge port has a circular cross section shape.

5. The compressor of claim 2, wherein at least one of the first discharge port or the second discharge port includes a plurality of holes.

6. A scroll compressor, comprising:

a first scroll having a first wrap formed on one surface of a first disk, and provided with a first discharge port and a second discharge port formed through the first disk in a thickness direction in a vicinity of an inner end of the first wrap, the first discharge port and the second discharge port being eccentric from a center of the first disk;

a second scroll having a second wrap formed on one surface of a second disk and engaged with the first wrap, an outer surface of the second wrap forming a first compression chamber together with an inner surface of the first wrap and an inner surface of the second wrap forming a second compression chamber together with an outer surface of the first wrap while the second scroll orbits with respect to the first scroll, the first compression chamber and the second compression chamber communicating with the first discharge port and the second discharge port, respectively; and a rotary shaft having an eccentric portion coupled through the second scroll to overlap the second wrap in a radial direction, wherein a discharge inlet and a discharge outlet of the first discharge port have a same sectional area, wherein a discharge inlet and a discharge outlet of the second discharge port have a same sectional area, and wherein the first discharge port and the second discharge port have different cross section shapes from each other.

7. The compressor of claim 6, wherein a time point at which the second discharge port is open with respect to the second compression chamber is earlier than a time point at which the first discharge port is open with respect to the first compression chamber.

8. The compressor of claim 6, wherein the first discharge port and the second discharge port have a same cross section shape.

9. The compressor of claim 6, wherein the second discharge port has a larger sectional area than the first discharge port.

10. A scroll compressor, comprising:

a casing having an inner space that stores oil therein;

a drive motor provided in the inner space of the casing;

a rotary shaft coupled to the drive motor;

a frame provided adjacent to the drive motor;

a first scroll provided adjacent to the frame, having a first wrap and a first disk, and provided with a first discharge port and a second discharge port spaced apart from each other by a predetermined interval in a vicinity of an inner end of the first wrap; and a second scroll provided between the frame and the first scroll, having a second wrap and a second disk and engaged with the first scroll, the rotary shaft being eccentrically coupled to the second wrap, the second scroll forming a first compression chamber and a second compression chamber together with the first scroll while performing an orbiting motion with respect to the first scroll, wherein the first discharge port is provided with a first discharge inlet and a first discharge outlet that communicate with the first compression chamber, and the second discharge port is provided with a second discharge inlet and a second discharge outlet that communicate with the second compression chamber, wherein the first discharge outlet and the first discharge inlet have a same sectional area, and the second discharge outlet and the second discharge inlet have a same sectional area, and wherein the second discharge inlet has a larger sectional area than the first discharge inlet.

11. The compressor of claim 10, wherein each of the first discharge inlet and the first discharge outlet has a noncircular cross section shape, and wherein each of the second discharge inlet and the second discharge outlet has a noncircular cross section shape.

12. The compressor of claim 10, wherein each of the first discharge inlet and the first discharge outlet has a circular cross section shape, and wherein each of the second discharge inlet and the second discharge outlet has a circular cross section shape.

13. The compressor of claim 10, wherein each of the first discharge inlet and the first discharge outlet includes a plurality of holes, and wherein the second discharge inlet and the second discharge outlet includes one hole.

14. The compressor of claim 10, wherein a time point at which the second discharge port is open with respect to the second compression chamber is earlier than a time point at which the first discharge port is open with respect to the first compression chamber.

15. The compressor of claim 10, wherein the first discharge port and the second discharge port have a same cross section shape.

16. The compressor of claim 15, wherein a geometric center of each discharge inlet and a geometric center of each discharge outlet of the first discharge port and the second discharge port are located on a same line.

17. The compressor of claim 10, wherein the first scroll is provided with a plurality of bypasses with predetermined intervals along a moving path of each of the first compression chamber and the second compression chamber, and wherein the bypasses adjacent to the second discharge port, among the plurality of bypasses formed in the second compression chamber, have a shortest interval therebetween.

* * * * *